United States Patent [19]

Shuch et al.

[11] Patent Number: 4,471,586

[45] Date of Patent: Sep. 18, 1984

[54] INDEPENDENT SHOP SUCH AS A NEWSPAPER KIOSK

[75] Inventors: André Shuch; Paul Le Cacheux; Alain Perrot, all of Paris, France

[73] Assignee: Ville de Paris, Paris, France

[21] Appl. No.: 295,875

[22] Filed: Aug. 24, 1981

[30] Foreign Application Priority Data

Sep. 4, 1980 [FR] France ..... 80 19070

[51] Int. Cl.[3] ..... A47G 29/00; A47F 3/11

[52] U.S. Cl. ..... 52/36; 52/71; 52/28; 312/138 A

[58] Field of Search ..... 52/36, 82, 28, 236.1, 52/32, 70, 71; 312/138 A, 138 R

[56] References Cited

U.S. PATENT DOCUMENTS

| | | | |
|---|---|---|---|
| Re. 24,723 | 10/1959 | Cornwell | 52/36 |
| 3,470,658 | 10/1969 | Orliac | 52/36 |
| 3,834,777 | 9/1974 | Swensson | 52/36 |
| 3,841,037 | 10/1974 | Clark | 52/36 |
| 3,945,132 | 3/1976 | Parmelee | 52/36 |
| 4,043,086 | 8/1977 | Kaulfuss et al. | 52/36 |
| 4,294,498 | 10/1981 | Van Luit | 312/138 R |

*Primary Examiner*—John E. Murtagh
*Assistant Examiner*—Michael Safavi
*Attorney, Agent, or Firm*—James Creighton Wray

[57] ABSTRACT

The shop such as a newspaper kiosk, may be installed on the pavements of towns for selling periodicals and newspapers.

The kiosk is so arranged that it permits an excellent display of the products in a region sheltered from wind and rain. The kiosk comprises a cell of trapezoidal shape the small base of which forms the rear wall (1) and the large base of which forms the openable front wall (4).

This cell comprises a supporting structure formed by at least four main posts (6 to 11) located at the four corners of the trapezium and interconnected by cross-members and by a roof framework. These posts act as supports for mounting product display box structures (5-7-8).

The kiosk is mainly used for the sale of newspapers, magazines, periodical or books.

19 Claims, 4 Drawing Figures

INDEPENDENT SHOP SUCH AS A NEWSPAPER KIOSK

The invention relates to an independent shop such as a newspaper kiosk and in particular to those placed on the pavements of towns for selling periodicals and daily newspapers.

Kiosks employed heretofore in towns for the sale of newspapers usually comprise a fixed shelter of square or rectangular shape, the front side of which opens and includes a counter while the lateral sides are usually extended by windshields or flexible walls of plastics or canvas for the purpose of shielding as far as possible the articles displayed for sale. Owing to their design, these kiosks are inaesthetic and often contrast with the harmony of the surrounding buildings, since their flexible walls have an unfortunate tendency to come away and flap in the wind and thus soil the newspapers heaped in an haphazard manner outside. Further, the various shape of these kiosks is incompatible with a correct display and a correct arrangement of the articles which discourages the buyer who does not have before him a complete and panoramic view of the newspapers and periodicals. Lastly with such kiosks, it is difficult to define precisely the area occupied thereby on the ground, each vendor trying to increase in a disorderly manner the area assigned to him by the addition of detachable walls which thus impart to the various kiosks of the same town dissimilar and often ugly appearances.

An object of invention is to overcome these various drawbacks and to provide for this purpose an independent shop which may be employed in particular as a newspaper kiosk, although this application is not intended to be limitative, this shop having the feature of being of a shape and design which permit an excellent presentation of the products while perfectly adapting itself, from the aesthetic point of view, to the present day town furnishing in large towns, the area on the ground of the cell forming said shop being capable of being increased in a rational and identical manner for all the cells so that the aforementioned disparity can be avoided.

The invention consequently provides an independent shop for display and sale of products, such as a newspaper kiosk, said shop comprising a cell of trapezoidal shape the small base of which forms the rear wall and the large base of which forms the openable front wall, said cell consisting of a supporting structure formed by at least four main posts located at the four corners of the trapezium and interconnected by cross-members and by a roof framework, said posts acting as a support for the attachment of boxes for displaying the products.

According to one feature of the invention, the display boxes, are formed by trapezoidal modules, the small base of which faces outwardly.

A shop according to the invention is shown by way of a non-limitative example in the accompanying drawings in which.

Figure 1:
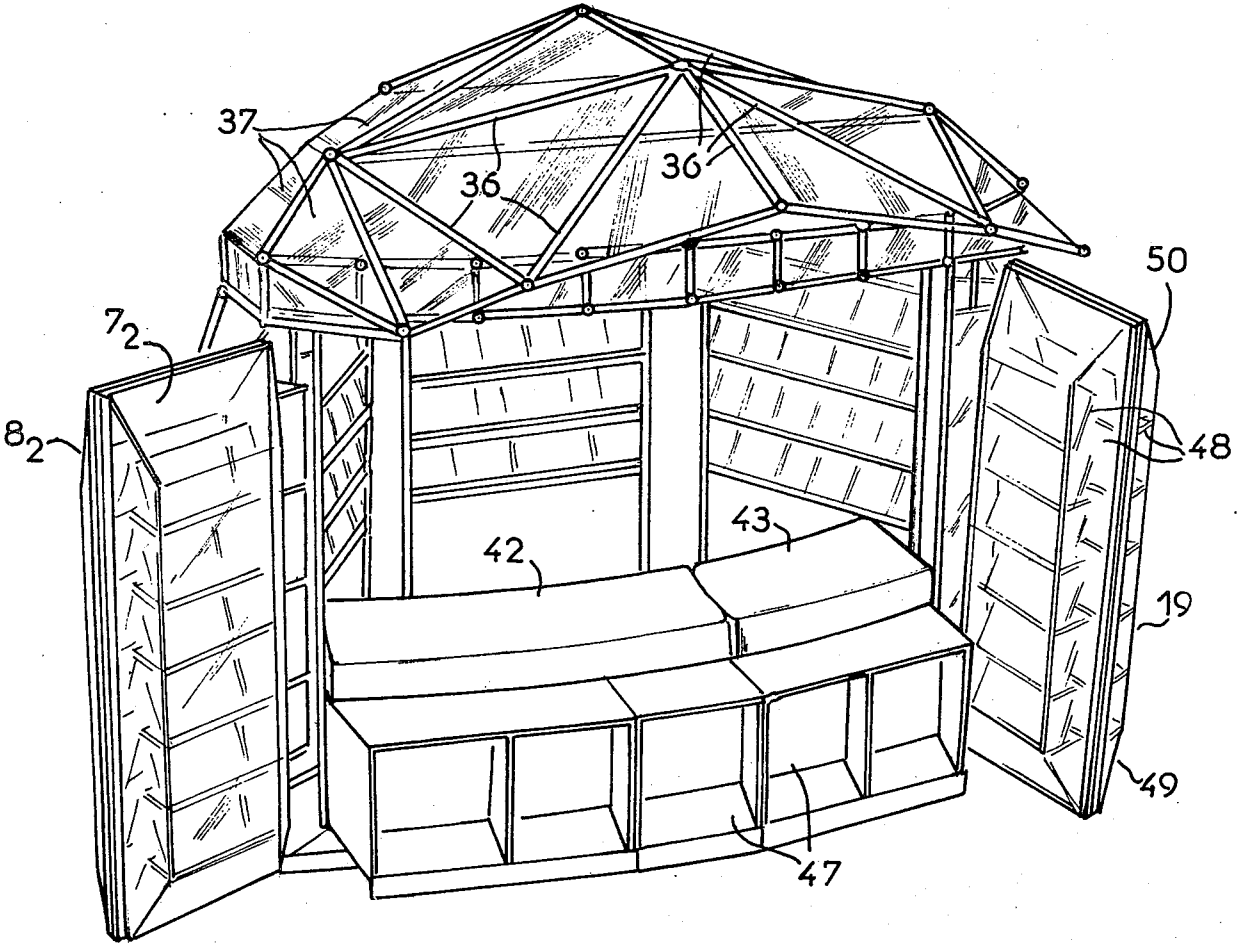
FIG. 1 is a perspective view of the shop with the front side thereof open.

The independent structure shop according to the invention is in the form of a small structure which may be placed on the pavements of towns for the display and sale of articles and in particular for the sale of newspapers. Newspapers is here intended to cover any articles of paper such as daily newspapers, periodicals, books or magazines usually found in fixed kiosks.

The structure concerned is in the form of a construction of trapezoidal type defined by a rear wall 1 (constituting the small base of the trapezium), two lateral walls 2 and 3 which diverge from the rear wall 1, and a front wall 4 (constituting the large base of the trapezium), the latter corresponding to the front side of the shop.

The rear wall 1 and the two lateral walls 2 and 3 are each formed by a box structure constituting a module of trapezoidal cross-sectional shape, these three box structures 5 being assembled by two corner posts 6 which have a hexagonal cross-sectional shape. The front side 4 is formed by two articulated doors each of which is constituted by two modules 7 and 8 of trapezoidal section interconnected by a vertical pivot pin 9, each of the two doors being pivotally mounted on a pin 10 carried by a corner post 11 which, like the post 6, is of hexagonal cross-sectional shape.

The pin 10 is fixed to the corner post 11, but the pin 9 is movable and follows the movements of the door, the upper end of this pin 9 being guided in a curved slideway 12 which is permanently fixed under the roof framework in a horizontal plane. The radius of curvature of this slideway 12 has for centre the pivot pin 10 of the doors. In this way, each door may be brought either to the closed position illustrated in dot-dash lines at $7_1$, $8_1$ (FIG. 2) or to the mid-way position illustrated at 7 and 8 or to the opened-out position shown at $7_2$, $8_2$, the two modules constituting a door being then folded against each other, base to base.

Figure 4:
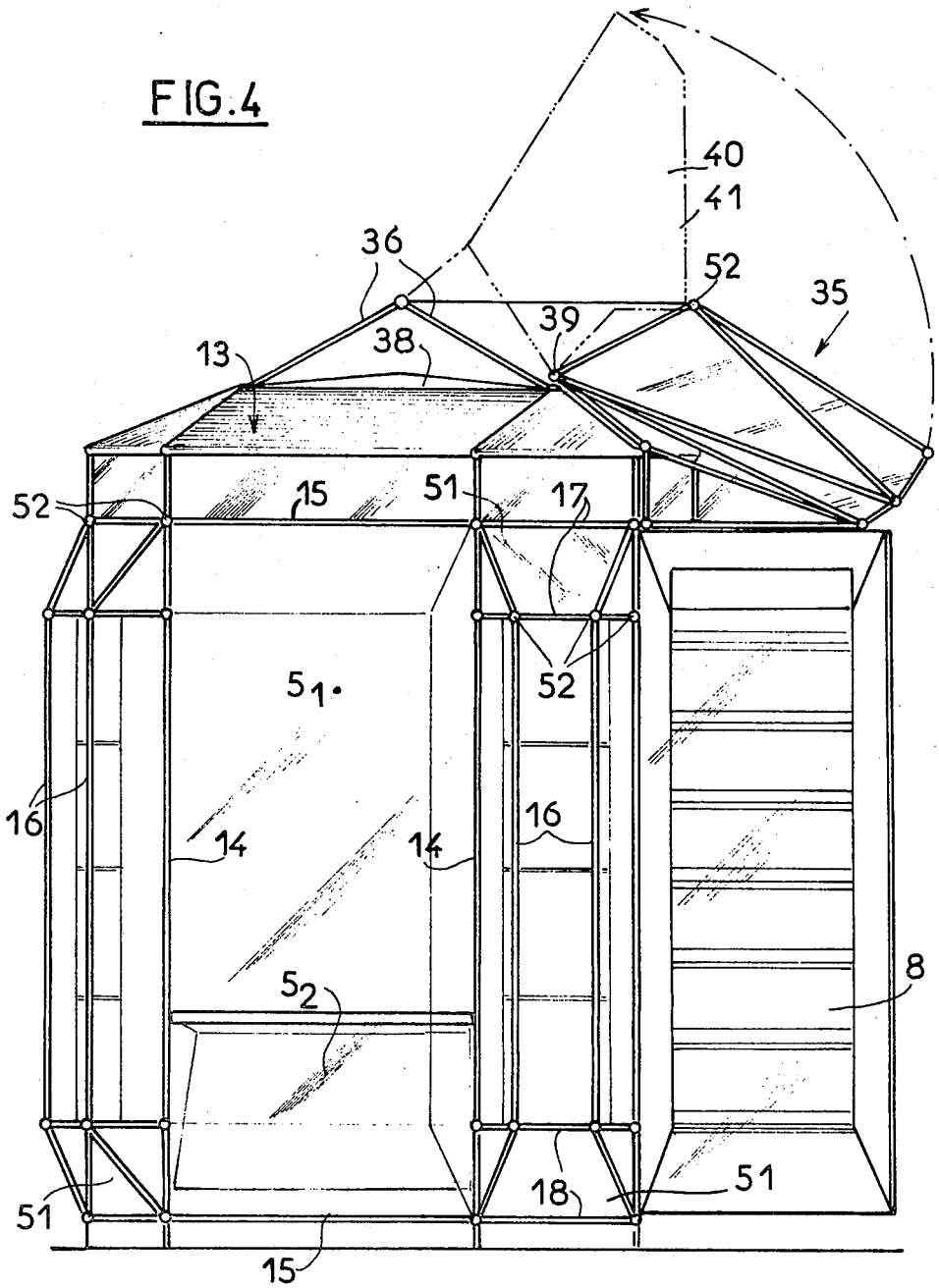
FIG. 4 is a side elevational view of the shop shown in FIG. 1.

The supporting frame of this shop comprises welded tubular elements which constitute both vertical uprights for supporting the box structures and the framework supporting the roof elements 13 (FIG. 4). Each box structure 5, 7 or 8 thus comprises two tubular section members 14 (FIGS. 2 and 4) which are interconnected in their lower and upper parts by tubular cross-members 15, whereas the four corner posts 6 and 11, which complete the trapezoidal cell of the shop, are formed by six tubular section-members 16 (FIG. 2) disposed at each of their corners, the latter being connected (FIG. 4) by welded tubular cross-members 17 and 18. The various box structures 5, 7 and 8 are formed (FIG. 2) by a planar wall 19 bordered by inclined lateral walls 20, the walls 19 and 20 being made from a cut-out transparent material and adhered together edge-to-edge and supported by the tubular frame. This material may be of "Securit" glass or in the form of panels of plastics material. The three outer sides 21 of the corner posts 6 and 11 (FIG. 2) are also made from a transparent material which is cut out and adhered, these corner posts comprising a rear wall 22 acting as a display sign or poster surface. The inner volume 23 remaining in each corner post 6 defines a cabinet which may act as a locker for the shopkeeper or form a housing for the electric equipment of the installation.

The two corner posts 11 bordering the front side 4 of the shop also have transparent outer sides 21. Each post encloses a prism structure 25 which is rotatable about a vertical axis by an electric motor 26. This prism structure has a triangular cross-sectional shape in the presently-described embodiment and also acts as a display sign surface and is suitably illuminated by means such as neon tubes 27 included in the supporting structure, in particular in the outer corner section-members 16. These section members have at least one axial slot 28 facing the prism structure 25 so as to direct the illumination onto the sides of the prism structure and concentrate the light and thus provide a highly effective beam. The three box structures 5 forming the rear wall and the two lateral walls of the trapezoidal cell are also illuminated from inside (FIG. 2) by conventional tubes 29 located at the rear of the rear wall of said box structures which acts as a support for display sign purposes, this rear wall being made for this purpose from a translucent material, for example frosted glass or plastics material, so as to illuminate by transparency the posters notices or display signs fixed on this wall 13.

Figure 2:
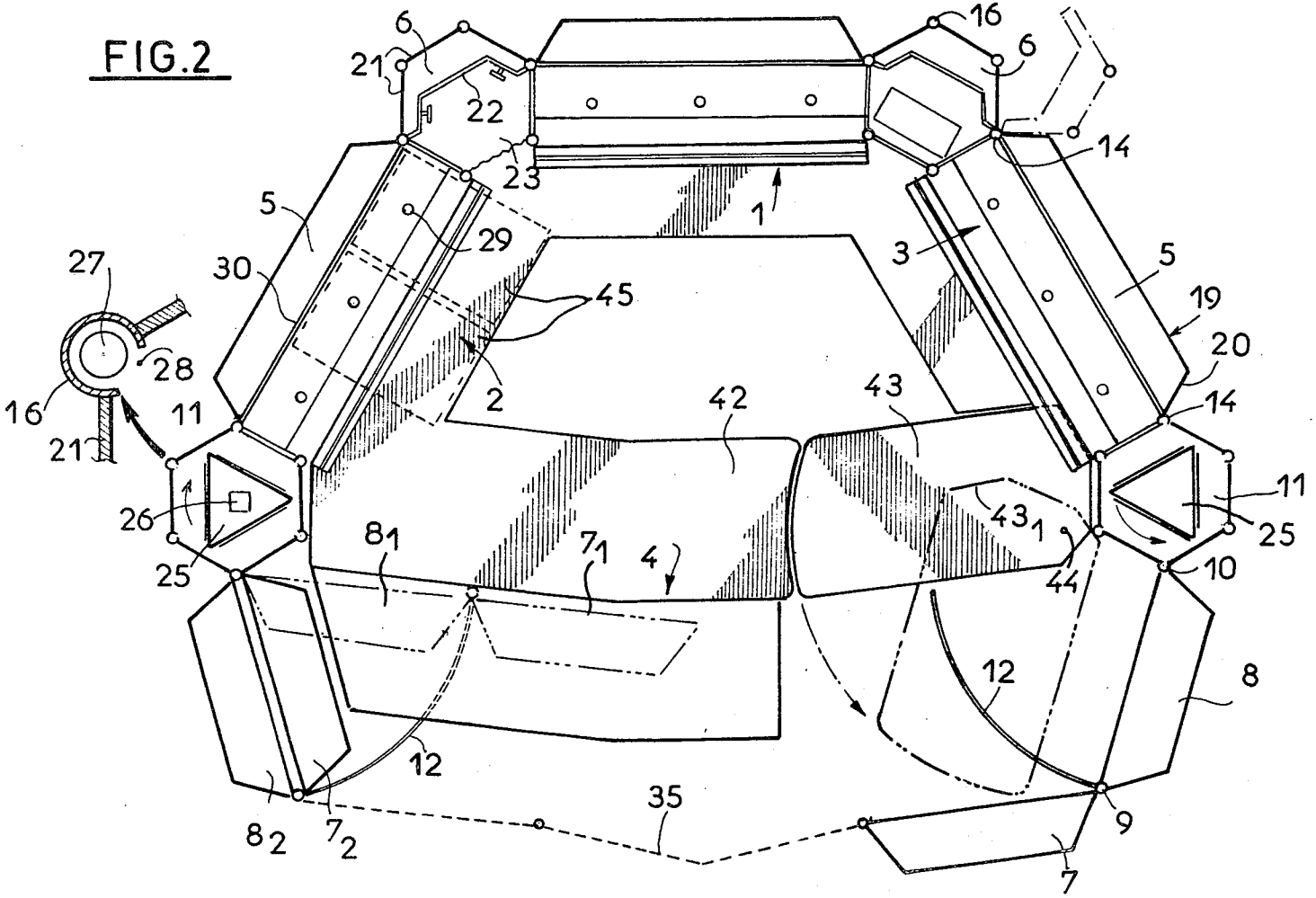
FIG. 2 is a diagrammatic top plan view thereof, the roof part having been removed.

The box structures 5 comprise (FIG. 4) two superimposed compartments $5_1$, $5_2$ each of which is accessible from outside owing to the fact that the walls 19 and 20 shown in FIG. 2 form a cover which is pivotally mounted on a transverse pin parallel to the cross-members 15, each of the two compartments being provided with an independent latch (not shown). The compartment $5_2$ acts as a storage compartment which enables the person in charge of the shop, after the shop has been closed, to place in this compartment the stock of newspapers or magazines to be sold and to take back the unsold newspapers or magazines that the salesgirl left for him in this compartment when closing the shop.

Figure 3:
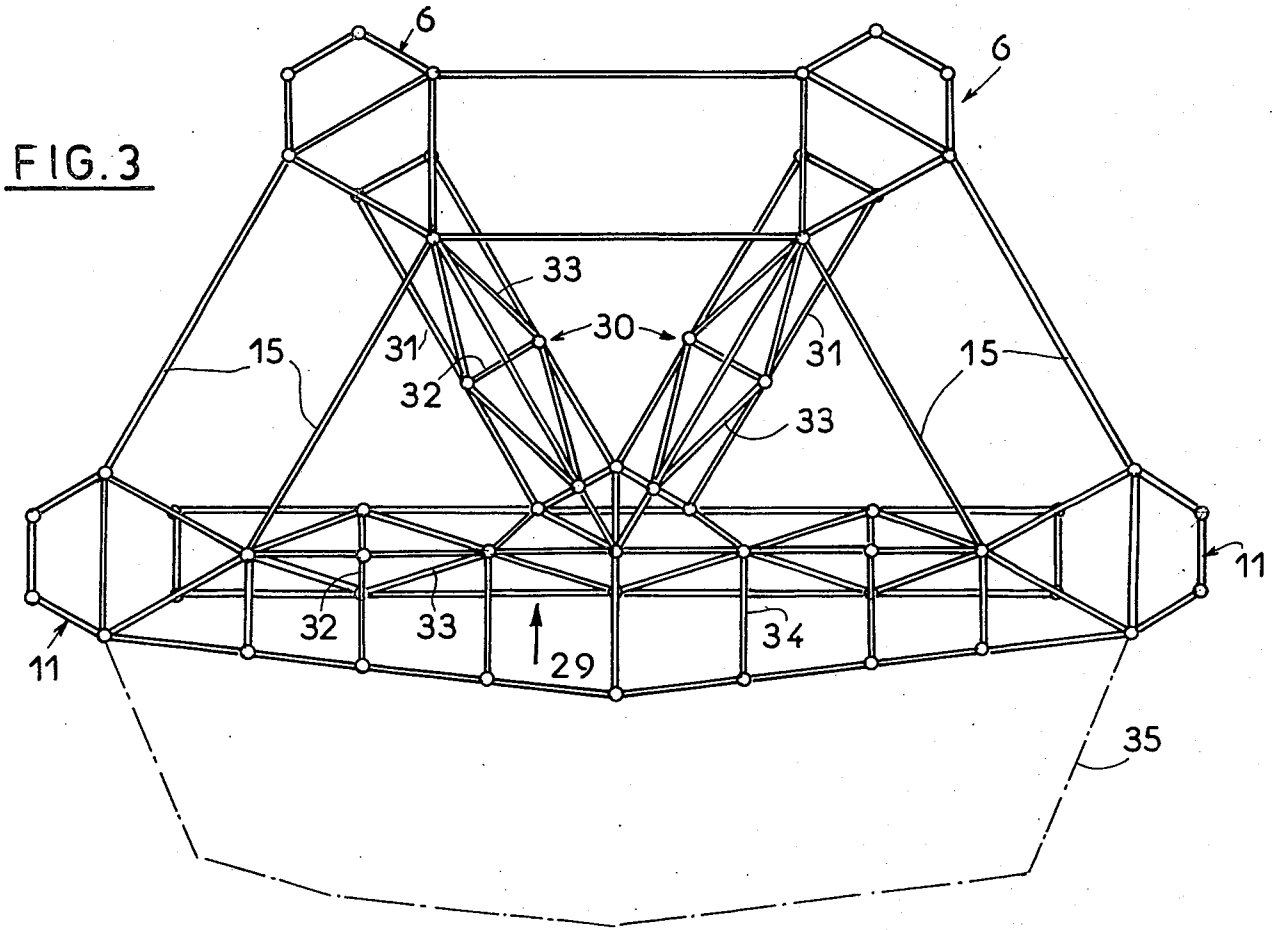
FIG. 3 is a top plan view of the structure supporting the roof elements.

The roof framework of the shop comprises a main beam 29 which interconnects the two corner posts 11 bordering the front side 4 of the shop, this beam being connected to the other two corner posts 6 by two secondary beams 30 which extend from the centre of the main beam to the corner posts 6. These two beams 29 and 30 comprise welded tubular elements, namely longitudinal elements 31 and transverse elements 32, which are triangulated by tubular reinforcements 33, the main beam 29 being extended forwardly by parallel section members 34 constituting a projecting part which will act as a support for a canopy 35 as shown in FIGS. 3 and 4. This tubular framework acts as a support for fixing other tubular section members 36 (FIG. 1) dividing the roof into a series of triangular regions of different geometry, thereby imparting to the roof a particularly original and aesthetic appearance. The panels 38 (FIG. 4), which close the upper part of the cell and are carried by the beams 29 and 30 shown in FIG. 3, are located below the section members 36 since the latter have a purely aesthetic function.

The canopy 35 (FIG. 4) may be pivotally mounted on a transverse pivot pin 39 and may be brought to the position illustrated in full lines or to the raised position 40 illustrated in dot-dash lines, the canopy occupying the position illustrated in full lines when the shop is opened and the second position when the shop is closed. It will be understood that the side 41 of the canopy may also act as a display sign or poster surface or as a sign board and may be illuminated from within if required, since this display sign surface will be preferably used at night.

The counter of the shop comprises two or three parts 42, 43 (FIG. 2) at least one of which is pivotally mounted on a pivot pin 44 so as to be pivotable outwardly to the position shown at $43_1$ so as to enable the person in charge of the shop to enter the latter. Likewise, the box structures 5 are rendered accessible from inside the shop by means of articulated doors (not shown) and each box structure may of course be provided with newspapers or trays 45 (FIG. 2). In the case of FIG. 1, the counter has two parts in front of which is provided a display or show surface 47 which permits an improved presentation of the products. As concerns this presentation, the box structure 5, 7 and 8 are in this respect provided with inclined racks or brackets 48 against which the articles displayed for sale are placed, the inner side of the box structure 5 being provided with rows of racks 48 for displaying the articles whereas the outer side of these box structures merely act, in the same way as the corner posts, as display sign surfaces as shown FIG. 4. The box structures 5 and the box structures 7 and 8 forming articulated doors have a trapezoidal cross-sectional shape not only in the transverse direction but also in the longitudinal direction so that the walls 19 are borded in their lower and upper parts by inclined walls 49, 50, the lower wall 49 having the advantage of spacing the base of the box structures away from the feet of the users and thus avoiding breakage of glass. This feature is also included in the region of the corner posts which also have inclined lower and upper walls 51, these walls being connected to their respective cross-members 17 and 18.

As mentioned before, the whole of the frame including the roof framework, is made from welded tubular section members, the junction points of the various section members constituting the uprights, the cross-members or the roof section members, being in the form of balls 52 (FIG. 4) which again impart to the structure a particularly original appearance. Further, as described herein before, the tubular section members and the ball shaped junctions 52 may advantageously receive illuminating means or serve for the passage of electric conductors so as to avoid spoiling the desired harmonious appearance.

The presently-described shop is consequently of a particularly aesthetic design and yet permits above all an excellent display of the products on sale, owing to its trapezoidal shape which widens the range of vision and rows of inclined racks which permit an ordered arrangement of the products, it being possible to increase the display volume of the cell by opening doors without departing from the general configuration of the structure.

We claim:

1. An independent shop for the display and sale of products, such as a newspaper kiosk, said shop comprising a cell of trapezoidal shape, the small base of which forms the inner wall and the large base of which forms the openable front wall of the shop, said cell comprising a supporting structure formed by at least four main posts located at the four corners of the trapezium and interconnected by cross-members and by a roof framework, the posts acting as support for mounting product display structures whose display is visible at least internally from the front of said shop, the corner posts having a hexagonal cross-sectional shape, each of the six edges of the hexagonal shape being defined by a tubular section member, the assembly of the section members of all of the posts being interconnected by the cross-members, which latter are connected to the roof framework which is also formed by welded tubular section members.

2. A shop according to claim 1, wherein the supporting structure is made from welded tubular section members.

3. A shop according to claim 1, wherein the junction points of the section members, the cross-members and the framework form ball-shaped members.

4. A shop according to claim 1, wherein the display box structures are formed by trapezoidal modules, the small base of which modules faces outwardly.

5. A shop according to claim 3, wherein the display box structures are made from a cut-out and adhered transparent material.

6. A shop according to claim 4 or 5, wherein the lower and upper sides of the display box structures and of the corner posts have an inclined trapezium shape.

7. A shop according to claim 1, wherein the corner posts form, in section, two trapezium which are interconnected by their bases, at least the outer trapezium being formed by cut-out and adhered transparent elements.

8. A shop according to claim 1, wherein the two corner posts bordering the front side of the cell enclose a rotary prism structure driven in rotation by an electric motor, said prism structure providing display sign surfaces.

9. A shop according to claim 1, wherein at least a part of the tubular section members forming the frame of the corner posts are split axially and enclose a source of illumination, the slit being oriented towards the articles put on sale.

10. A shop according to claim 4 wherein the display box structures are illuminated by tubes located behind their rear side which are made from frosted glass or translucent plastics material.

11. A shop according to claim 10, wherein the fixed display box structures form the rear side and the two divergent lateral sides are the trapezoidal cell.

12. A shop according to claim 10, wherein the box structures are transversely divided into two compartments both of which comprises an articulated and lockable front side permitting access to said compartments.

13. A shop according to claim 1, wherein the front side of the cell comprises two doors each of which doors is formed by two box structures which are pivoted together by a vertical pivot pin, each door being pivotally mounted on the supporting structure.

14. A shop according to claim 13, wherein the vertical pivot pin of the box structures is guided during the movement of the door by a curved guide rail fixed in the region of the upper edge of the door.

15. A shop according to claim 13, wherein the articulated box structures forming the doors have trapezoidal transverse and longitudinal sections, and the end box structures are capable of being folded against the box structures pivotally mounted on the supporting structure.

16. A shop according to claim 1, wherein the framework comprises a main beam including tubular section members interconnecting the two corner posts bordering the front side of the cell, said beam being assembled with the other two corner posts by secondary beams which are also formed by welded tubular section members.

17. A shop according to claim 16, wherein the main beam is extended forwardly of the cell by an articulated canopy formed by welded tubular elements.

18. A shop according to claim 1, wherein the cell includes a counter formed by two parts at least one of which parts is pivotally mounted on the supporting structure.

19. A shop according to claim 4 wherein the display box structures, including those of the doors, include racks which are inclined relative to a vertical plane and on which racks are displayed for sale articles such as books, newspapers, periodicals or the like.

* * * * *